US008479620B2

(12) United States Patent
Chen

(10) Patent No.: US 8,479,620 B2
(45) Date of Patent: Jul. 9, 2013

(54) TORQUE-SETTING DEVICE

(75) Inventor: Xuan-Ren Chen, Taichung (TW)

(73) Assignee: Mikawa Co., Ltd., Taichung (TW)

( * ) Notice: Subject to any disclaimer, the term of this patent is extended or adjusted under 35 U.S.C. 154(b) by 382 days.

(21) Appl. No.: 12/830,308

(22) Filed: Jul. 3, 2010

(65) Prior Publication Data

US 2012/0000328 A1 Jan. 5, 2012

(51) Int. Cl.
*B25B 23/143* (2006.01)

(52) U.S. Cl.
USPC ..... 81/467; 81/478

(58) Field of Classification Search
USPC ..... 81/467, 478, 480–483; 73/862.21–862.23
See application file for complete search history.

(56) References Cited

U.S. PATENT DOCUMENTS

| | | | | |
|---|---|---|---|---|
| 6,332,382 | B1 * | 12/2001 | Anderson et al. | 81/438 |
| 6,334,377 | B1 * | 1/2002 | Wu | 81/478 |
| 7,836,781 | B1 * | 11/2010 | Chen | 73/862.22 |
| 8,245,606 | B2 * | 8/2012 | Chiang | 81/483 |
| 2009/0320654 | A1 * | 12/2009 | Wu | 81/478 |

* cited by examiner

*Primary Examiner* — Hadi Shakeri

(57) ABSTRACT

A torque-setting device includes a shank, a handle provided on the shank, a driving unit attached to the shank, a strain gauge connected to the driving unit, a spring abutted against the strain gauge, a pusher abutted against the spring, an axle engaged with the pusher, a restraining element connected to the axle, a C-clip provided on the restraining element, and a knob. The knob is operable to rotate the axle relative to the pusher, thus moving the pusher relative to the spring to set a value of torque. The knob is movable between a position where teeth thereof are in grooves of the handle to avoid rotation of the axle and another position where the tooth are out of the grooves to allow rotation of the knob and the axle. The C-clip is located against an annular rib formed on an internal face of the knob.

4 Claims, 3 Drawing Sheets

TORQUE-SETTING DEVICE

BACKGROUND OF INVENTION

1. Field of Invention

The present invention relates to a torque-providing tool and, more particularly, to a torque-setting device for use in a torque-providing tool.

2. Related Prior Art

As disclosed in U.S. Pat. No. 6,334,377, an adjustable-torque wrench includes a shank 10, a head 11, a spring 15, a follower 13, a pin 14, a handle 20, a lock fastener 21, a lock nut 23, a control ferrule 30 and a knob 26. The head 11 is secured to an end of the shank 10. The spring 15 is located in the shank 10. A section of the follower 13 is located in the shank 10, against the spring 15. The pin 14 is driven in the follower 13 via a slot 12 defined in the shank 10. Thus, the section of the follower 13 is movably but not rotationally located in the shank 10. The follower 13 includes an extension 16 with a reduced diameter, thus forming a shoulder 17.

First and second threads are formed on an internal face of the handle 20. The first thread of the handle 20 is engaged with a thread 18 formed on the shank 10. The second thread of the handle 20 is engaged with a thread of the lock fastener 21. The thread of the lock fastener 21 is engaged with a thread of the lock nut 23. Thus, the handle 20, the lock fastener 21 and the lock nut 23 can only be rotated together. The extension 16 is inserted through an orifice 22 of the lock fastener 21. The shoulder 17 is located against the lock fastener 21. In use, the handle 20 is rotated around and hence moved along the shank 10 to make the lock fastener 21 push the follower 13. Hence, the follower 13 compresses the spring 15.

The control ferrule 30 is movably located between the handle 20 and the knob 26 that is secured to the extension 16 of the follower 13. In a position, teeth 31 formed on an internal face of the control ferrule 30 are engaged with teeth 24 formed on the handle 20 and teeth 28 formed on the knob 26. Thus, the handle 20 cannot be rotated relative to the knob 26, the follower 13 and the shank 10. Hence, torque cannot be adjusted. In another position, the teeth 31 of the control ferrule 30 are disengaged from the teeth 28 of the knob 26. Thus, the handle 20 can be rotated relative to the knob 26, the follower 13 and the shank 10. Therefore, torque can be adjusted.

As disclosed in co-pending U.S. patent application Ser. No. 12/434,662 filed by the present applicant, a torque-setting device includes a handle 10, a sleeve 15, a driving unit 11, a spring 20, a pusher, an axle 30, a knob 40 and a positioning unit 50. The sleeve 15 is attached to an end of the handle 10. The sleeve 15 includes grooves 18 defined in an internal face. The driving unit 11 is attached to an end of the handle 10 and connected to a strain gauge. The spring 20 is abutted against the strain gauge within the handle 10. The pushing element 33 is movably but not rotationally located in the handle and abutted against the spring 20.

The axle 30 includes a section rotationally but not movably located in the handle 10 and engaged with the pushing element 33. Thus, rotation of the axle 30 relative to the pushing element 33 causes movement of the pushing element 33 relative to the axle 30 and hence the spring 20 to set a value of torque.

The knob 40 is formed with a tooth 42. The knob 40 is connected to another section of the axle 30. The knob 40 is operable to rotate the axle 30 relative to the pushing element 33. The knob 40 is movable between a first position and a second position. In the first position, the tooth 42 is inserted in one of the grooves 18 of the handle 10 to retain the value of torque. In the second position, the tooth 42 is removed from the grooves 18 to allow the rotation of the knob 40.

The positioning unit 50 includes a lining 56 and a spring-biased detent assembly. The lining 56 is disposed in the knob 40 so that they cannot be rotated or moved relative to each other. The spring-biased detent assembly includes a spring 54 disposed in a recess 53 defined in the restraining element 36 and a detent 55 biased with the spring 54. The detent 55 is formed like a cap for receiving a section of the spring 54. The detent 55 is in contact with the internal side of the lining 56. The detent 55 can be located against the annular rib formed on an internal face of lining 56 to restrain the positioning unit 50 relative to the sleeve 15.

The present invention is therefore intended to obviate or at least alleviate the problems encountered in prior art.

SUMMARY OF INVENTION

It is the primary objective of the present invention to provide a tool with a precision, reliable torque-setting device.

To achieve the foregoing objective, the tool includes a handle, a shank, an axle, a knob, a restraining element and a C-clip. The handle includes grooves defined in an internal face. The shank is partially inserted in the handle. The axle is operable for moving a pusher for pushing a spring against a strain gauge connected to the shank. The axle includes a section rotationally but not movably located in the shank. The knob is operable to rotate the axle relative to the pusher to move the pusher relative to the axle against the spring to set a value of torque. The knob is movable between a position to insert the teeth in the grooves to avoid the rotation of the knob and another position to locate the teeth out of the grooves to allow the rotation of the knob. The restraining element includes an annular flange formed on an external face and an annular groove defined in the external face. The restraining element is connected to the axle. The annular flange is in contact with the knob. The C-clip includes an internal edge located in the annular groove and an external edge located against the annular rib.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
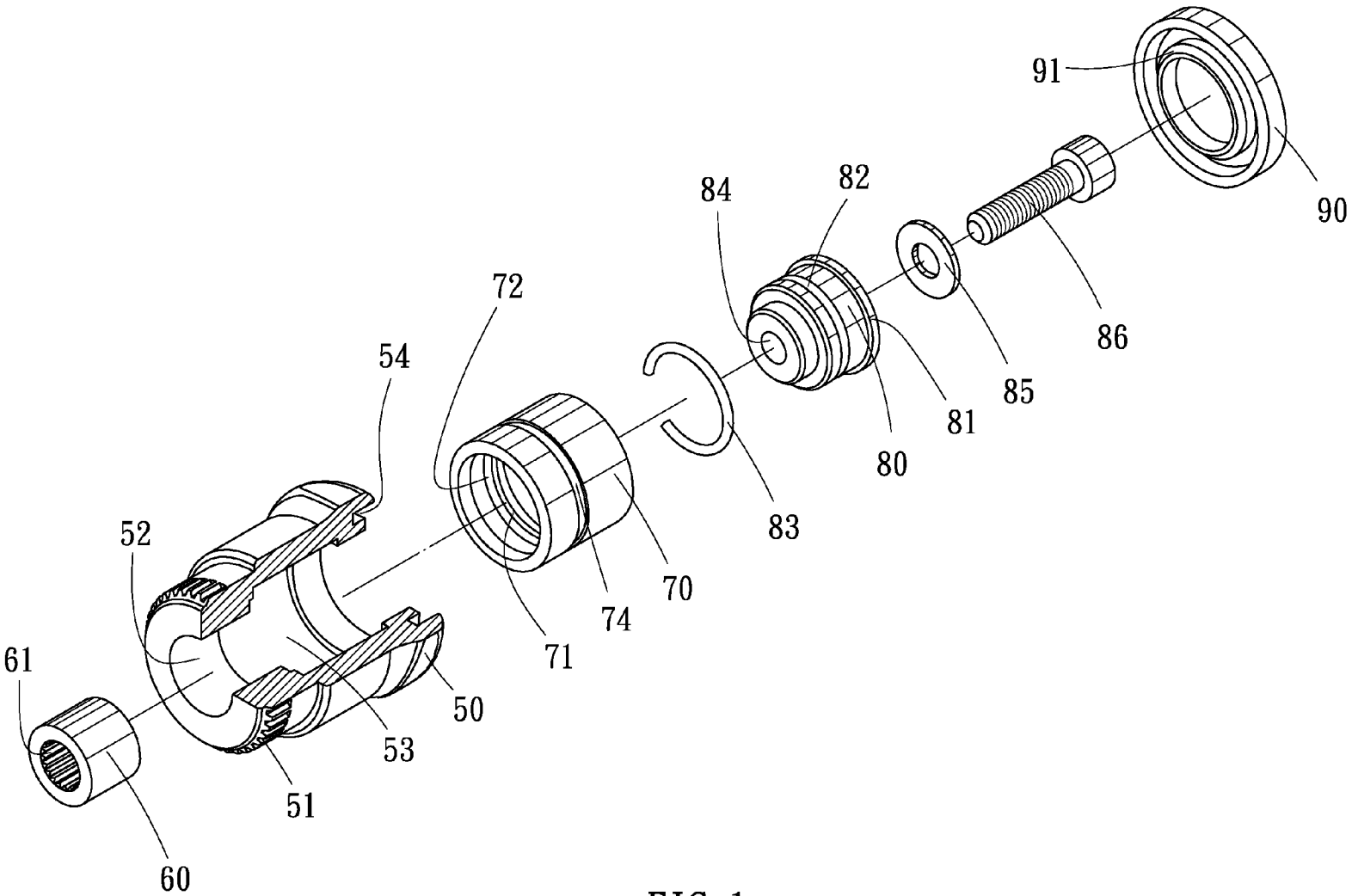
FIG. 1 is an exploded view of a torque-setting device according to the preferred embodiment of the present invention.
Figure 2:
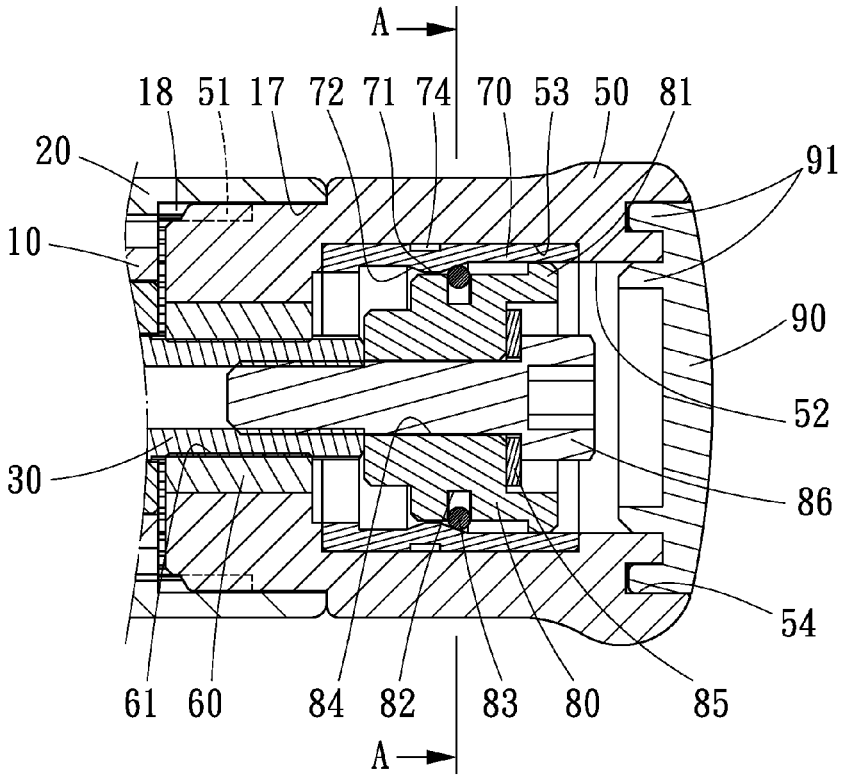
FIG. 2 is an enlarged cross-sectional view of the torque-setting device shown in FIG. 1.
Figure 3:
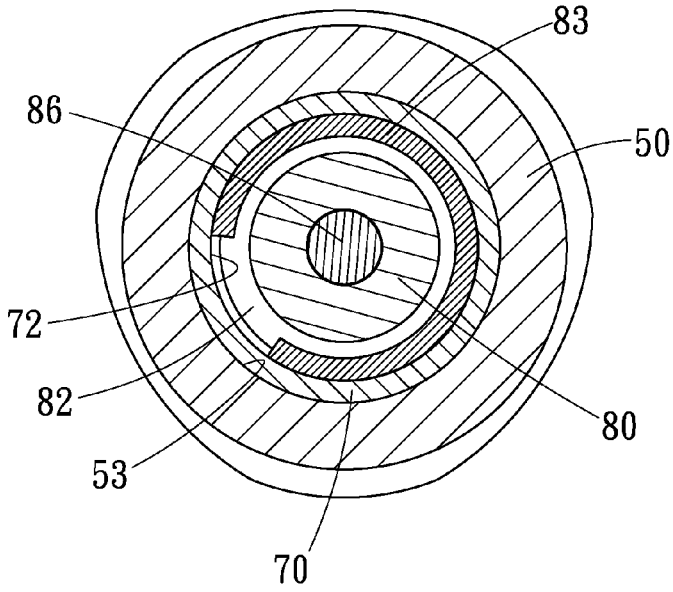
FIG. 3 is a cross-sectional view of the torque-setting taken along a line A-A shown in FIG. 2.

Referring to FIGS. 1 through 3, a tool is equipped with a torque-setting device according to the preferred embodiment of the present invention. The tool includes a shank 10, a handle 20 connected to an end of the shank 10, and a driving unit connected to an opposite end of the shank 10. The shank 10 and the handle 20 are hollow. Details of the shank 10, the handle 20 and the driving unit are given in co-pending U.S. patent application Ser. No. 12/434,662 filed by the present applicant and entirely incorporated herein for reference.

The torque-setting device includes a strain gauge, a spring, a pusher, an axle 30, a knob 50, a first lining 60, a second lining 70, a restraining element 80 and a plug 90. The strain gauge is connected to the driving unit. The spring is in contact with the strain gauge. The pusher is in contact with the spring. The pusher is preferably a nut disposed in the shank 10. A pin includes an end movably disposed in a slot defined in the shank 10 and another end driven in the pusher. Thus, the pusher is movable but not rotational in the shank 10. A thread formed on the axle 30 is engaged with a thread formed on an internal face of the pusher. Thus, rotation of the axle 30 causes the movement of the pusher. The movement of the pusher causes change in the stress in the spring. Thus, a value of torque to be exerted by the tool is adjusted. Details of the spring, the pusher, the pin and the axle 30 are given in co-pending U.S. patent application Ser. No. 12/434,662.

The knob 50 is a hollow element with a space 53 defined therein. The knob 50 further includes an aperture 52 in communication with the space 53 and an annular groove 54 defined in and along an annular edge thereof. The diameter of the aperture 52 is smaller than that of the space 53, thus forming an annular shoulder between them. Moreover, the knob 50 includes teeth 51 formed on a reduced section thereof. The reduced section of the knob 50 is inserted in the handle 20, with the teeth 51 inserted in the grooves 18.

An external face of the first lining 60 is attached to an internal face of the reduced section of the knob 50 by an adhesive material for example. An external face of the first lining 60 is formed with teeth 61 movably located in grooves defined in the periphery of the axle 30.

The second lining 70 includes an annular rib 71 formed on an internal face thereof and an annular groove 74 defined in an external face corresponding to the annular rib 71. The second lining 70 is made of an elastic material so that the annular rib 71 is flexible. The annular groove 74 is made to increase the flexibility of the annular rib 71. The annular rib 71 includes two slopes 72. The second lining 70 is located in the space 53, with an end thereof located against the annular shoulder between the aperture 52 and the space 53 of the knob 50. An external face of the second lining 70 is attached to an internal face of the knob 50 by an adhesive material for example. The second lining 70 and the knob 50 can be made one in another embodiment.

The restraining element 80 includes a tunnel 84 axially defined therein, an annular flange 81 formed on an external face thereof, and an annular groove 82 defined in the external face thereof. An internal edge of a C-clip 83 is located in the annular groove 82. The restraining element 80 is located in the second lining 70.

A screw 86 includes a thread and a shank. The screw 86 is inserted in a washer 85, the restraining element 80 and the axle 30. The shank of the screw 86 is located in the tunnel 84. The thread of the screw 86 is engaged with a thread formed on an internal face of the axle 30. Thus, the restraining element 80 is connected to the axle 30 by the screw 86.

The plug 90 includes two annular ribs 91 formed on a face thereof. The first annular rib 91 is fit in the annular groove 54. The second annular rib 91 is located against the wall of the aperture 52. Thus, the plug 90 is connected to the knob 50 to protect the other elements from dirt. The plug 90 can be replaced with a cap mounted on the knob 50 in another embodiment.

Referring to FIGS. 2 and 3, the first slope 72 of the annular rib 71 is abutted against an external edge of the C-clip 83. The teeth 51 are retained in the grooves 18 so that the knob 50 is prevented from rotation relative to the handle 20. Hence, the axle 30 cannot be rotated relative to the pusher. The pusher cannot be moved relative to the spring. A value of torque is set and retained.

Figure 4:
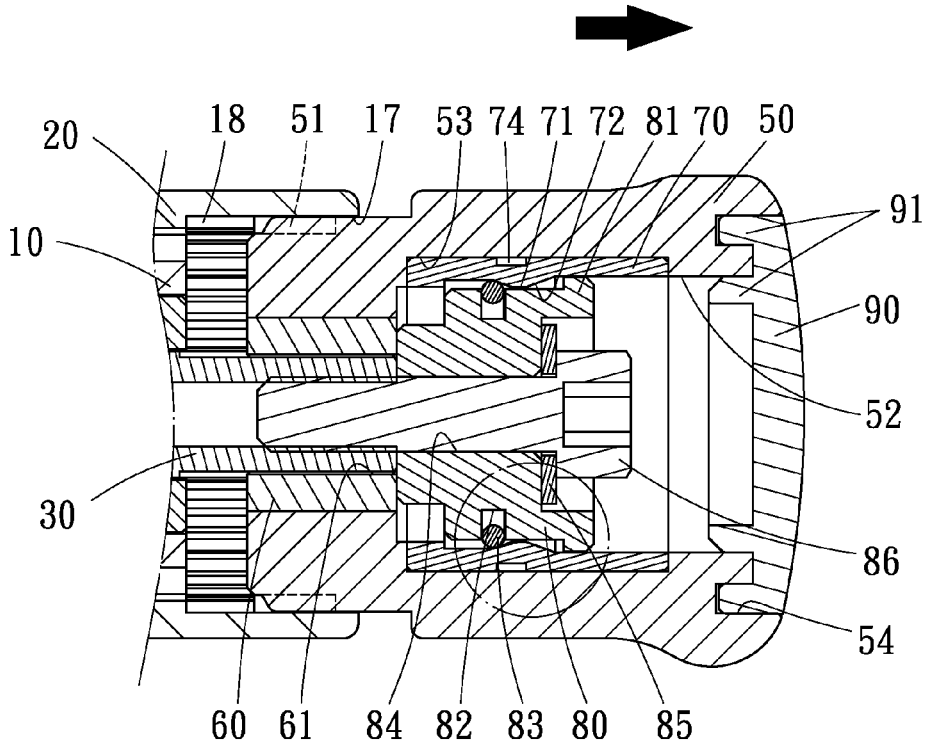
FIG. 4 is a cross-sectional view of the torque-setting device in another position than shown in FIG. 2.
Figure 5:
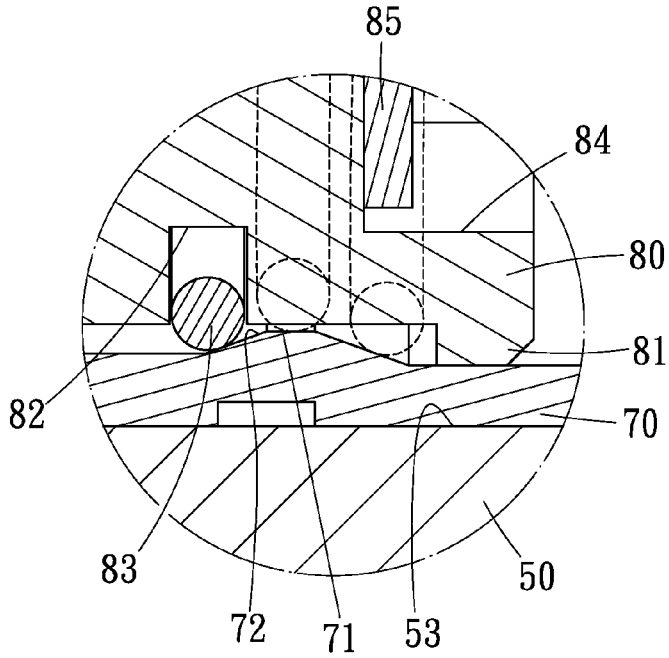
FIG. 5 is a cross-sectional view of the torque-setting device of FIG. 4.

Referring to FIG. 4, the knob 50 is moved relative to the handle 20, overcoming the force exerted on the annular rib 71 from the C-clip and hence the restraining element 80. Referring to FIG. 5, the C-clip 83 contracts and sinks into the groove 82 as it travels to the top of the annular rib 71 from the first slope 72. The C-clip 83 contracts and sinks into the groove 82 as it travels to the second slope 72 from the top of the annular rib 71. The teeth 51 are located outside the grooves 18 so that the knob 50 can be rotated relative to the handle 20. Therefore, the axle 30 can be rotated relative to the pusher. The pusher can be moved relative to the spring. Another value of torque can be set.

The knob 50 can be returned to the axial position relative to the handle 20 shown in FIGS. 2 and 3. Thus, the teeth 51 are located in the grooves 18. Hence, the new value of torque is retained.

The annular flange 81 slides on the internal face of the second lining 70 when the C-clip 83 slides on the slope 71. Therefore, the movement of the restraining element 80 relative to the second lining 70 is rendered smooth.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A torque-setting device including:

a handle including grooves defined in an internal face;

a shank partially inserted in the handle;

an axle operable for moving a pusher for pushing a spring against a strain gauge connected to the shank, wherein the axle includes a section rotationally but not movably located in the shank;

a knob including teeth formed on an external face and an annular rib formed on an internal face, wherein the knob is movable but not rotational relative to the axle, wherein the knob is operable to rotate the axle relative to the pusher to move the pusher relative to the axle against the spring to set a value of torque, wherein the knob is movable between a position to insert the teeth in the grooves to avoid the rotation of the knob and a second position to locate the teeth out of the grooves to allow the rotation of the knob;

a restraining element including an annular flange formed on an external face and an annular groove defined in the external face thereof, wherein the restraining element is connected to the axle, wherein the annular flange is in contact with the knob; and a C-clip including an internal edge located in the annular groove and an external edge located against the annular rib.

2. The torque-setting device according to claim 1, including a first lining provided between the axle and knob so that the knob is movable but not rotational relative to the axle.

3. The torque-setting device according to claim 1, including a second lining located between the knob and the restraining element, wherein annular rib is formed on an internal face of the second lining.

4. The torque-setting device according to claim 3, wherein the second lining includes an annular groove defined in an external face corresponding to the annular rib to increase the flexibility of the annular rib.

* * * * *